US006793610B2

(12) United States Patent
Deola

(10) Patent No.: US 6,793,610 B2
(45) Date of Patent: Sep. 21, 2004

(54) COLLAPSIBLE EXERCISER

(76) Inventor: James A. Deola, 2584 S. Lincoln Ave., Vineland, NJ (US) 08361

( * ) Notice: Subject to any disclaimer, the term of this patent is extended or adjusted under 35 U.S.C. 154(b) by 102 days.

(21) Appl. No.: 10/047,254

(22) Filed: Jan. 14, 2002

(65) Prior Publication Data

US 2003/0134730 A1 Jul. 17, 2003

(51) Int. Cl.[7] ..... A63B 69/06
(52) U.S. Cl. ..... 482/130; 482/142; 482/72
(58) Field of Search ..... 482/52, 51, 57, 482/72, 112, 62, 95, 96, 130, 142

(56) References Cited

U.S. PATENT DOCUMENTS 326,247 A * 9/1885 Root
5,393,286 A * 2/1995 Cheng
5,527,243 A * 6/1996 Chen
5,601,519 A * 2/1997 Comereski
5,616,111 A * 4/1997 Randolph
6,533,710 B2 * 3/2003 Lin et al.

* cited by examiner

*Primary Examiner*—Jerome W. Donnelly
(74) *Attorney, Agent, or Firm*—Norman E. Lehrer

(57) ABSTRACT

An exercising apparatus is disclosed which can be easily collapsed for shipping or storage but which is easily assembled for use. The apparatus includes an upper frame member pivotally attached to the forward end of a longitudinally extending lower base frame member. The upper frame member supports a seat including a bottom that is movable so as to be parallel to the frame member for shipping or perpendicular for use. An elongated rod has one end pivoted to the upper frame member. The other end is pivoted to a collar that surrounds the base frame member and moves along a length thereof between a shipping position where the frame members are parallel to each other and an operative position where the upper frame member extends upwardly. A pin and aperture arrangement locks the frame members in the selected position. A pair of movable arms with handles connected to an adjustable force resistor allows a user to perform a variety of exercises of the arms and upper body. The force resistor includes a plurality of elastic elements mounted for pivotal movement between operative and inoperative positions so that any combination of the elements can be used. Squats can also be performed by the user placing his feet on foot support blocks located at the rear of the apparatus, grasping the movable arms and extending his legs against the force of the force resistor.

21 Claims, 8 Drawing Sheets

COLLAPSIBLE EXERCISER

BACKGROUND OF THE INVENTION

The present invention is directed toward an exercising apparatus and, more particularly, toward an apparatus that can be easily collapsed for shipping and storage but easily erected and which allows a user to perform a variety of exercises. The invention is also directed to a novel adjustable force resistor that may be used with numerous different types of exercising equipment.

The benefits of exercise and particularly weight bearing exercise are well known. Such exercises are not only good for one's general overall health and appearance but help to build muscle and supporting tissue in order to protect bones and joints from injury particularly as one ages. Different muscle groups, of course, require different exercises. That is, no one particular weight bearing exercise is capable of developing all of the muscles in a person's body.

While simple exercises such as push-ups or sit-ups or squats can be performed by a person in his or her home or in substantially any location, most other exercises required for exercising other muscle groups require weights or exercise apparatus or machines. Since different exercises are required with different muscle groups, this normally would also require the use of various pieces of exercise equipment. This, of course, is not a problem at a gym or other location where substantial space is available for the various pieces of equipment that would be needed. Furthermore, the costs that are involved are justified since the equipment would be used by numerous people.

Most people, however, do not have the space at home that would be needed for numerous pieces of equipment. Equipment has, therefore, been designed which is capable of allowing a user to perform numerous different types of weight bearing exercises. This equipment, however, is frequently somewhat complex and requires substantial assembly by the user.

While it may be possible to ship such prior art systems in more fully assembled forms, this significantly increases the cost of shipping and, therefore, the cost of the equipment to the user. There has, therefore, been a continuing need in the industry for an exercise apparatus which is capable of allowing a user to perform various types of exercises and which can be significantly collapsed for shipping or storage but easily and readily assembled by the user when it is desired to utilize the same.

As is also well known in the art, exercise machines allow a user to perform weight bearing exercises and which are frequently referred to as weight machines use one of two common systems for providing the force or weight. The first is referred to as a weight stack which includes a plurality of weights stacked on top of each other. One or more of these weights can be connected to a cable for vertical movement which cable is linked to a movable element such as a movable arm by way of a linkage system such as cables and pulley mechanisms. The amount of weight is adjusted by selecting the number of weight elements to be connected to the cable. All of this is, of course, well known in the art.

The second common type of adjustable force resistance means is the use of a plurality of rubber bands. The rubber bands are elastomeric elements particularly in the shape of a ring or oval or the like. A number of such bands are provided with each frequently having a different elastomeric force. The bands are manually connected between a fixed frame member and a movable element and the amount of force is selected by connecting any one or combination of the bands between the fixed frame and the element to be moved.

The elastomeric force resistors are the preferred system in home-type gyms since they weigh very little and, therefore, are less expensive to ship. Furthermore, they take up less space than weight stacks. However, each time the user wishes to change the force, he or she must get up from the exercise equipment which normally includes a seat or the like, remove the band that is in place and/or add an additional band. With prior art systems known to Applicant, however, this task, although not difficult, can be somewhat time consuming and clearly interrupts the flow of the exercise being performed.

Frequently, when one is doing a series of exercises, he or she wishes to gradually and relatively quickly increase or decrease the resist of force. To Applicant's knowledge, however, there is no known system which allows the user to quickly and easily add or subtract elastomeric elements in order to increase or decrease the force and particularly no such system exists which allows the user to do so while he or she remains seated on the exercise equipment.

SUMMARY OF THE INVENTION

The present invention is designed to overcome the deficiencies of the prior art described above. The exercise apparatus of the invention can be easily collapsed for shipping or storage but is easily assembled for use. The apparatus includes an upper frame member pivotally attached to the forward end of a longitudinally extending lower base frame member. The upper frame member supports a seat including a bottom that is movable so as to be parallel to the frame member for shipping or perpendicular for use. An elongated rod has one end pivoted to the upper frame member. The other end is pivoted to a collar that surrounds the base frame member and moves along a length thereof between a shipping position where the frame members are parallel to each other and an operative position where the upper frame member extends upwardly. A pin and aperture arrangement locks the frame members in the selected position.

A pair of movable arms with handles connected to an adjustable force resistor allows a user to perform a variety of exercises of the arms and upper body. The force resistor includes a plurality of elastic elements mounted for pivotal movement between operative and inoperative positions so that any combination of the elements can be used. As will be apparent to those skilled in the art, the novel force resistor of the invention can be easily adapted to substantially any exercise equipment that requires the use of a force resistor.

Squats can also be performed by the user placing his feet on foot support blocks located at the rear of the apparatus, grasping the movable arms and extending his legs against the force of the force resistor.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENT

Figure 1:
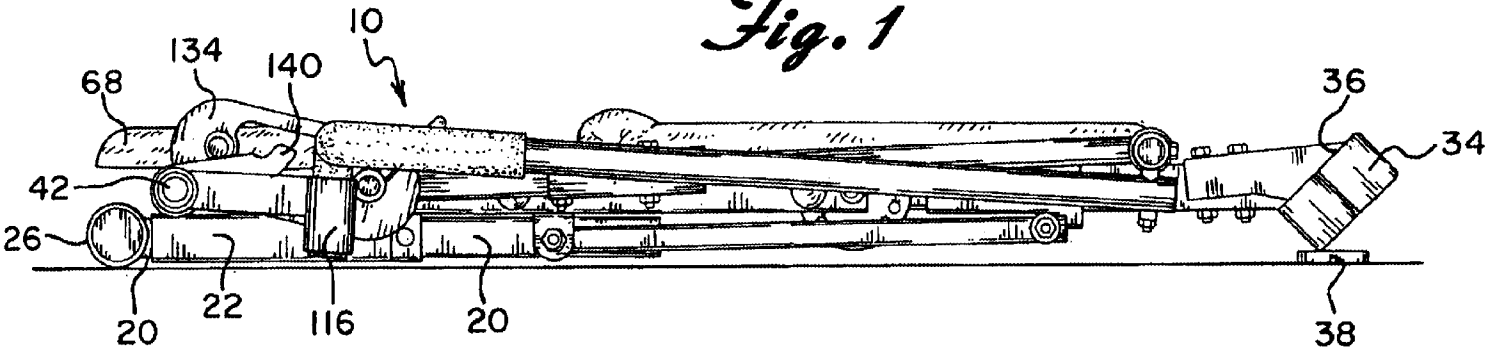
FIG. 1 is a side elevational view of a collapsible exerciser constructed in accordance with the principles of the present invention and show in its collapsed form for shipping or storage.

Referring now to the drawings in detail wherein like reference numerals have been used in both of the figures to designate like elements, there is shown in each of the figures a collapsible exerciser constructed in accordance with the principles of the present invention and designated generally as 10.

Figure 2:
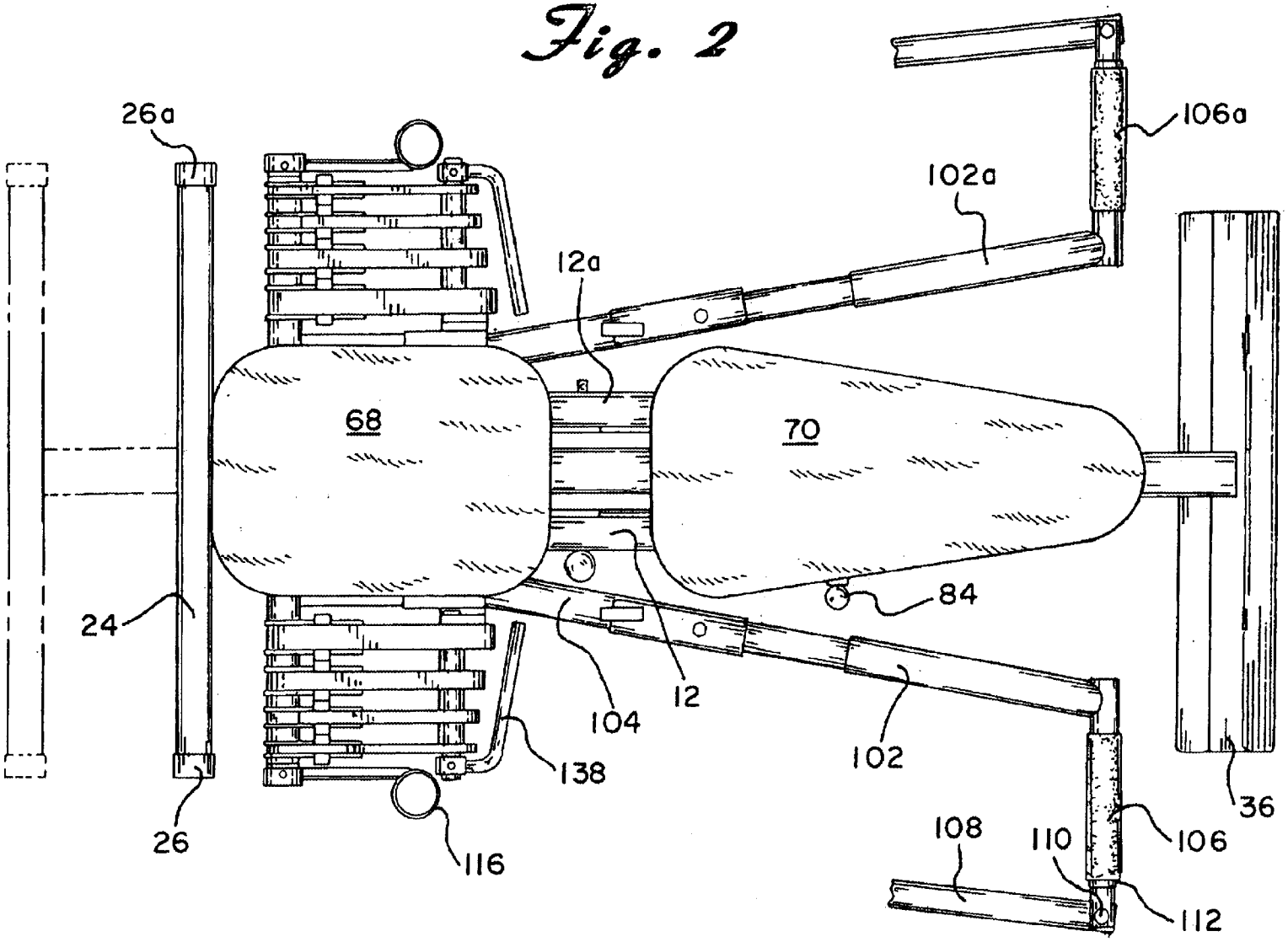
FIG. 2 is a top plan view of the exercise machine of FIG. 1.
Figure 3:
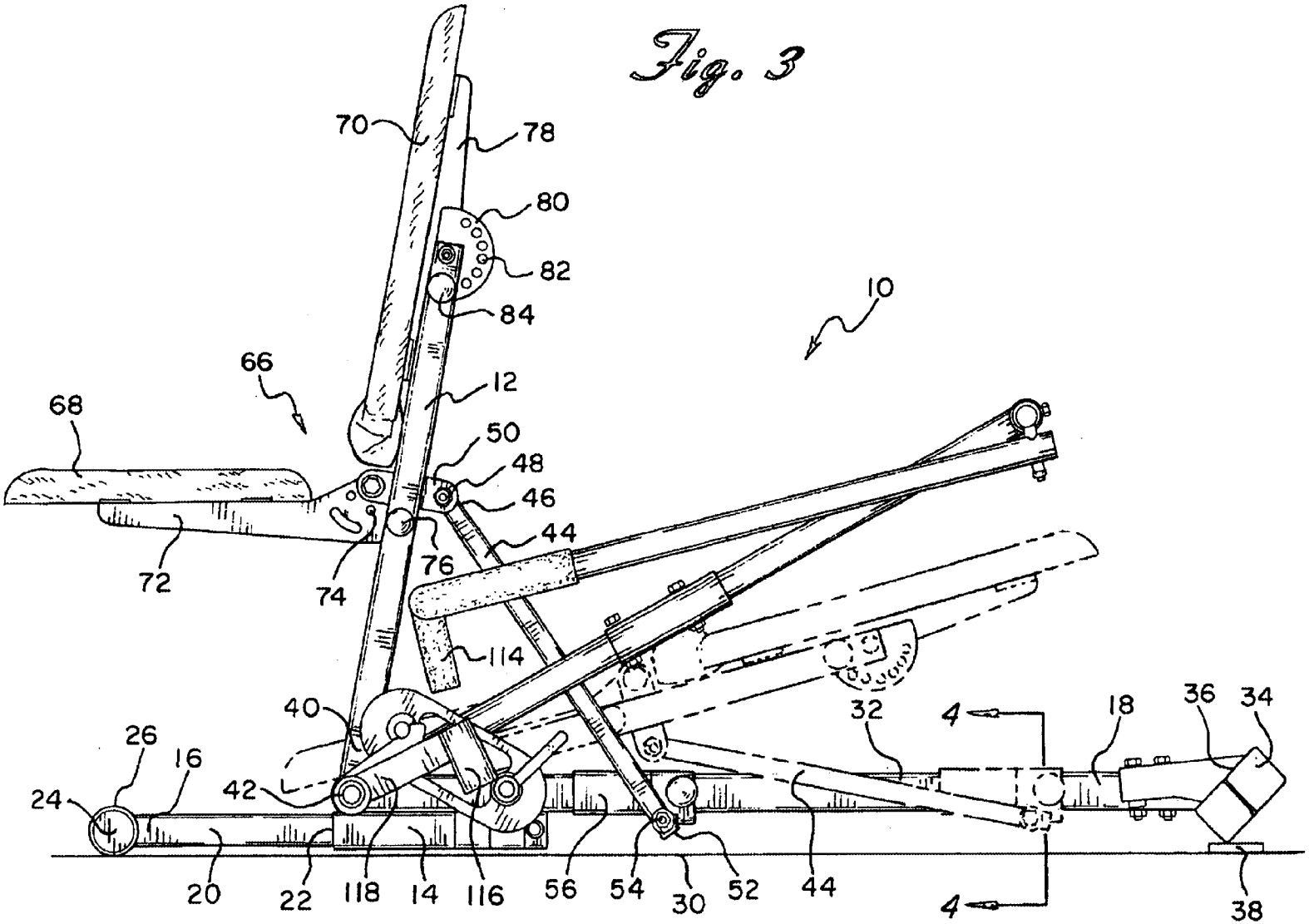
FIG. 3 is a side elevational view similar to FIG. 1 but showing the exerciser being erected for use.

The collapsible exerciser 10 is shown in its collapsed form in FIG. 1. This is essentially the form that it would be in when being shipped. FIG. 1 is a side view of the apparatus. FIG. 3 is a similar side view but illustrates the manner in which the apparatus is erected for use. FIG. 2 is an overall top plan view which illustrates the parts of the invention.

As is perhaps best shown in FIG. 2 and in the other figures such as 8 and 9 that illustrate the exerciser 10 from the top or end thereof, it is symmetrical from left to right along its longitudinal axis. That is, all of the components on the left side of the apparatus 10 are the identical mirror image of the components on the right side. Thus, while the following description may, in many cases, describe only one side of the apparatus, it should be readily apparent to those skilled in the art that the other side is constructed in essentially the same manner.

The exerciser 10 is comprised essentially of a frame which includes an upper frame member 12 and a lower base frame member 14. The lower base frame member 14 extends longitudinally along the center of the apparatus and has a forward end 16 and a rearward end 18. In order to adjust the length of the lower base frame member 14, the forward end 16 includes a tubular member 20 having a square cross section which telescopes into a slightly larger square-shaped tube 22. The tube 20 is telescoped into the tube 22 for shipping and storage as shown in FIG. 1 and is extended forwardly for support when the apparatus is erected as shown in FIG. 3. FIG. 2 illustrates both positions.

In order to provide stability to the lower base frame member 14, a crossbar 24 is secured to the forwardmost end of the tubular member 20. A pair of rubber caps 26 and 28 are connected to the ends of the bar 24 in order to provide feet for supporting the same on the ground or floor 30.

Figure 15:
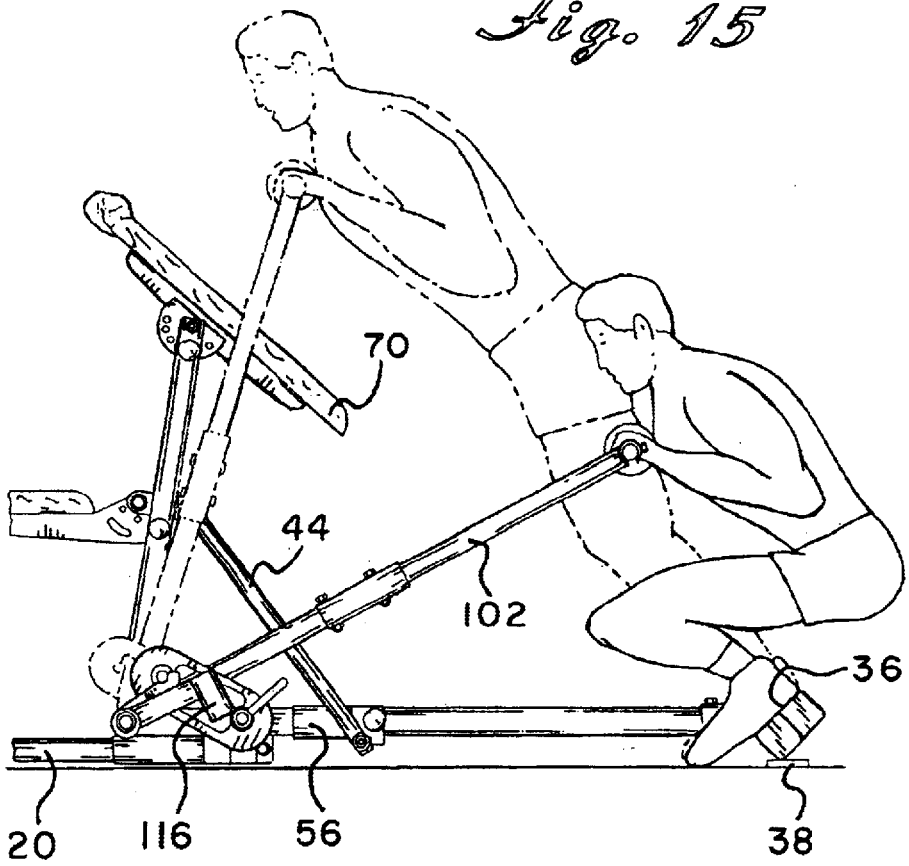
FIGS. 15 and 16 are side elevational views illustrating the exercise apparatus being used for performing leg squats.
Figure 16:
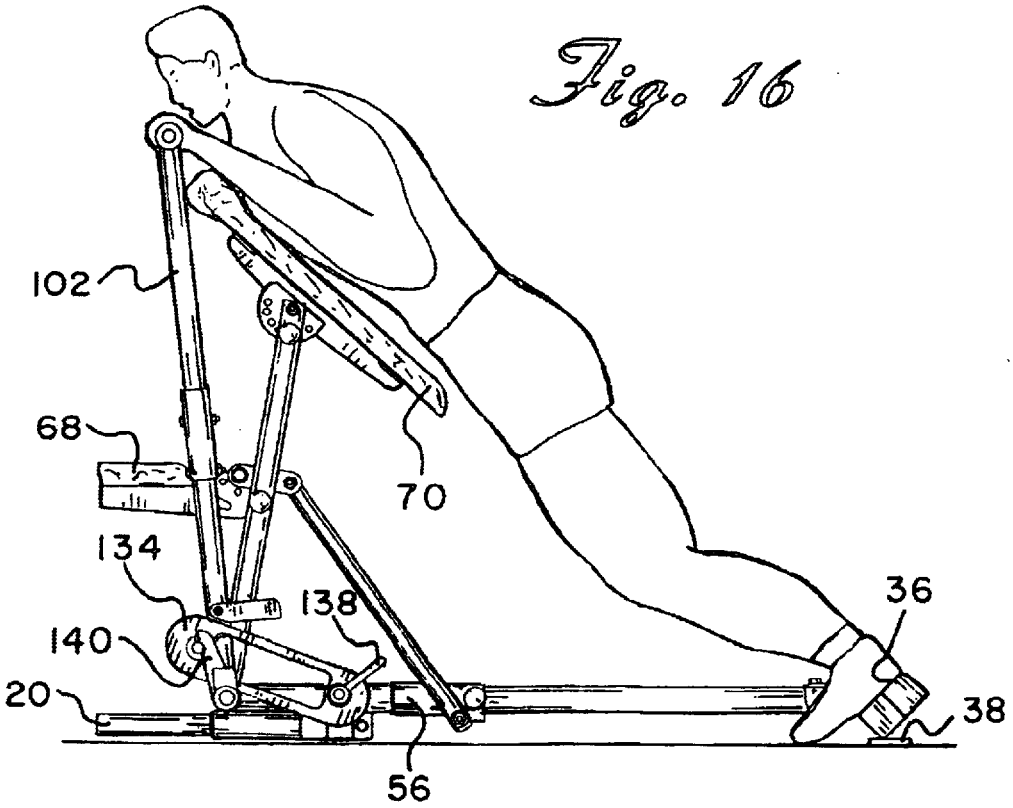

The rearward end 18 of the lower base frame member 14 is also constructed of an elongated tube 32 of square or rectangular cross section. The rearwardmost end of the tube 32 also carries a crossbar 34 which extends across the width of the apparatus 10 in order to provide stability for the lower base frame member 14 at the rear thereof. The rear crossbar 34, however, also includes a foot supporting surface 36 which is inclined at approximately 45° and which is capable of supporting a user's foot as shown in FIGS. 15 and 16 in such a way that the user's body is also inclined at approximately the same angle in the other direction with the person's toes resting on the floor 30. The purpose for this will be described in more detail hereinafter. A friction pad 38 made of rubber or the like is mounted to the bottom of the crossbar 34 in order to support the same on the floor 30.

The upper frame member 12 has its lowermost end 40 pivoted to the forward end of a lower base frame member 14 at 42. This allows the upper frame member to be movable between an inoperative, collapsed position as shown in FIG. 1 wherein it is substantially parallel to the lower base frame member 14 and an erect, operative position as shown in FIG. 3. FIG. 3 also shows an intermediate position of the upper frame member 12 in phantom.

The upper frame member 12 is guided between the two positions described above through the use of an elongated rod 44 which also helps to maintain the upper frame member 12 in its selected position. The upper or left end 46 (as viewed in FIG. 3) of the rod 44 is pivotally attached to the upper frame member 12 at point 48 through a tab 50 that extends rearwardly behind the upper frame member 12. The lowermost end 52, i.e. the right hand end, of the rod 44 is similarly pivoted at point 54 to a tab on a sleeve 56 that surrounds and is longitudinally slidable on the elongated tube 32 forming part of the lower base frame member 14. As best shown in FIG. 3, as the sleeve moves rearwardly or forwardly, the upper frame member 12 pivots between its lowermost collapsed position and its erect position.

Figure 4:
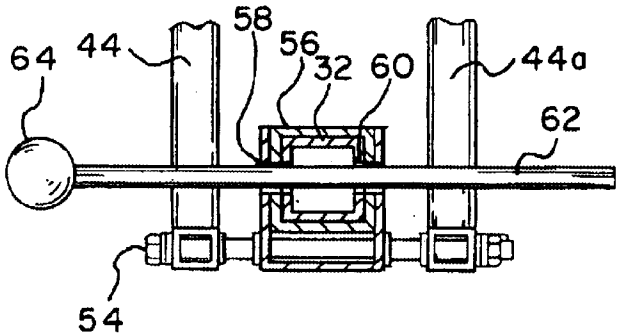
FIG. 4 is a cross sectional view taken through the line 4—4 of FIG. 3.

In order to fix the sleeve 56 in its desired position along the length of the elongated tubular member 32, the sleeve is provided with an aperture or opening 58 in the side wall thereof (see FIG. 4) while the tubular member 32 may be provided with a plurality of corresponding holes such as shown at 60 in FIG. 4. As should be readily apparent to those skilled in the art, one of the holes 60 will be located adjacent the rearward end of the tubular member 32 and a number of similar holes will be located adjacent the forward end thereof. When the sleeve 56 and, therefore, the upper frame member 12 are in their desired position, a pin 62 having a knob handle 64 is inserted through the aligned openings to lock the sleeve in its desired position as shown in FIG. 4. FIG. 4 also illustrates the point made above concerning the left to right symmetry of the present invention. Although reference has been made to a single elongated rod 44 connected to the upper frame member 12, as shown in FIG. 4, it is actually a pair of rods 44 and 44*a* connected to a pair of upper frame members 12 and 12*a* as can be seen in FIG. 2.

In some cases, it may be desirable to eliminate the sleeve 56 and provide a means for simply separating and removing the upper frame member 12 from the lower base frame member 14 for storage. This can be done by fabricating the lower ends 40 of the upper frame member 12 and the lowermost ends of the rods 44 and 44*a* in the form of pins and mounting complimentary sockets on the front end of the tube 22 and on an intermediate point of the tube 32. The upper frame member 12 can then be attached to the base frame member 14 by simply inserting the appropriate pins into the corresponding sockets. Locking means such as thumb screws or the like can be provided on the sockets for preventing accidental removal of the upper frame member 12 from the base frame member 14.

Seat 66 is mounted to the upper frame member 12. The seat 66 includes a seat bottom 68 and a seat back 70. The seat bottom 68 is pivoted to the upper frame member 12 through the use of a bracket 72 having a plurality of holes 74 therein. These holes 74 are alignable with a similar hole (not shown) in the upper frame member 12 through which a locking pin 76 can be inserted. This allows the seat bottom 68 to be moved as desired and locked in place between an inoperative position as shown in FIG. 1 wherein it is substantially parallel to the upper frame member 12 and an operative position as shown in FIG. 3 where it is substantially perpendicular to the frame member 12 thereby permitting a user to sit thereon while facing forwardly. The additional hole 74 may also allow for additional angular positions of the seat bottom 68.

The seat back 70 is similarly pivotally secured to the upper frame member 12 adjacent the top thereof through the use of a frame 78 having a plate 80 with a plurality of holes 82 therein. The seat back 70 can be pivoted about the top of the upper frame member 12 and locked in place utilizing a pin 84 that passes through a corresponding hole in the upper frame member 12 when the seat back is pivoted into its desired position. As should be readily apparent to those skilled in the art, the position shown in FIG. 3 is the operative position allowing a user to sit on the seat bottom 68 and lean back onto the seat back 70. The seat back 70, on the other hand, can be pivoted approximately 120° into the position shown in FIGS. 9, 15 and 16 to underlie a person doing squats from the rear of the exercise apparatus 10.

In order to perform various types of exercises, the apparatus 10 is provided with a pair of movable arms 102 and 102*a*. Since these two arms are substantially identical to each although mirror images, only one will be described in detail. It being understood that this description applies equally of the other two arms.

The arm 102 is comprised of several parts. The first is an elongated based member 104 having its lower most end pivotally secured to the axis 42 so as to be movable relative thereto. In its rest position, the base arm member 104 extends rearwardly and slightly outwardly from the center of the apparatus 10 as shown best in FIG. 2. A relatively short hand grip member 106 is rigidly secured to the free end of the base arm member 104 and extends at 90° outwardly away from the midline apparatus 10. One end of a secondary arm 108 is pivotally connected at point 110 to a rotating coupling mechanism 112 which, in turn, is connected to the intermediate member 106. This allows the secondary arm 108 to move in all directions 3600 with respect to the intermediate member 106 and, thus, the base arm member 104.

Figure 8:
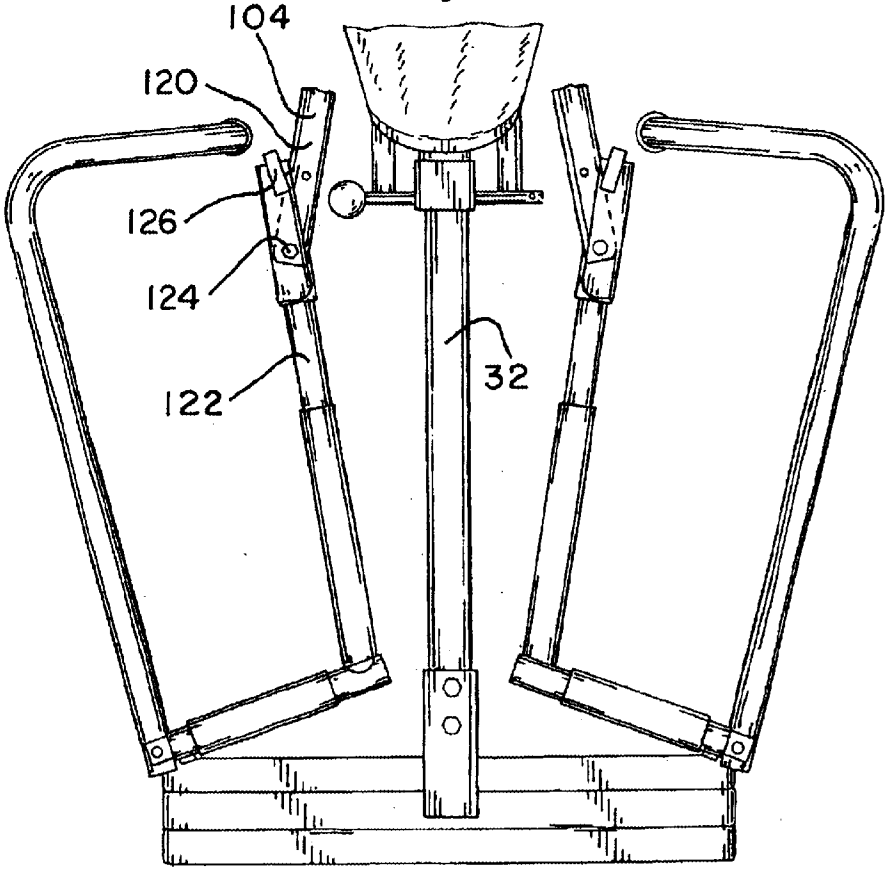
FIG. 8 is a top plan view of a portion of FIG. 1 showing the movable arms being assembled for use.

As shown best in FIG. 8, the forward end of the secondary arm 108 is bent inwardly toward the center line of the apparatus 10 and, as shown in FIG. 3, then extends downwardly to form a handle 114. A holder in the form of a cup 116 is also mounted for movement about the axis 42 so as to be movable with the arm base member 104. The holder 116 can be used to store or retain the handle 114 for shipping or storage or when the same is not needed for a particular exercise.

In order to make the entire apparatus somewhat more compact for shipping and storage purposes, the base arm member 104 of the arm 102 is preferably comprised of two parts. As shown best in FIG. 8, it is divided into a lower portion 120 and an upper portion 122 that are hinged together at point 124 and can be locked so as to be in alignment utilizing pin 126. This feature makes the apparatus narrower for shipping and storage purposes.

Figure 6:
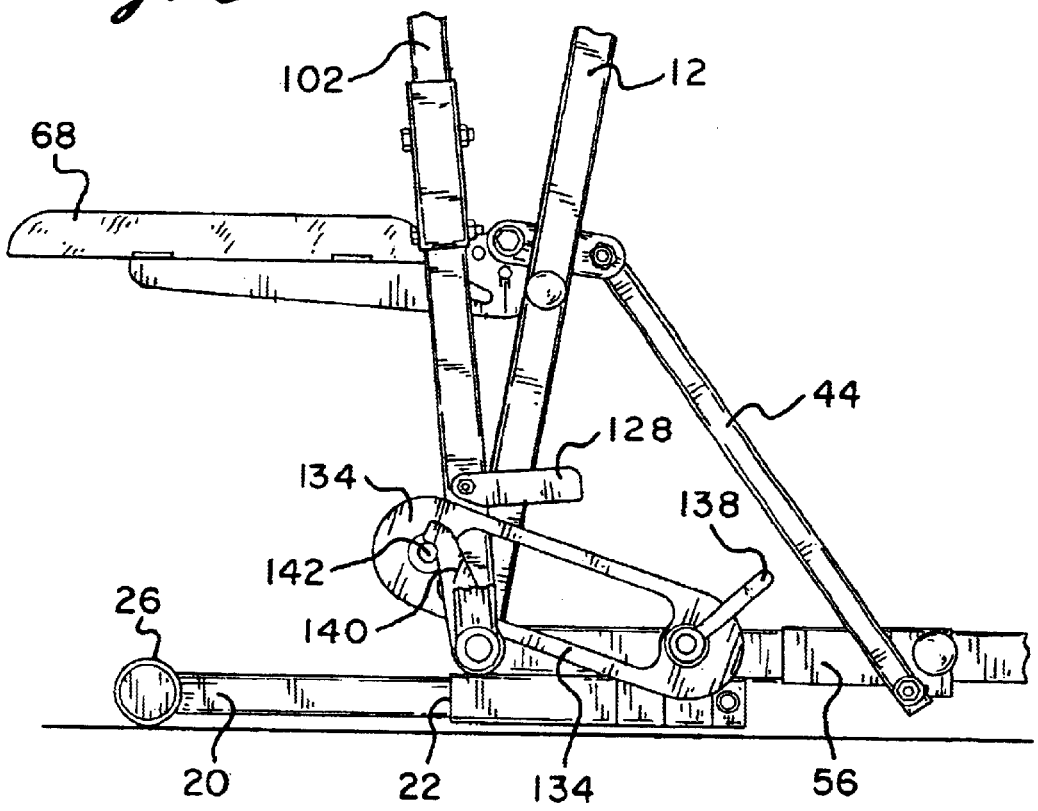
FIG. 6 is a side elevational view with portions broken away illustrating the operation of a part of the force resistor means.
Figure 7:
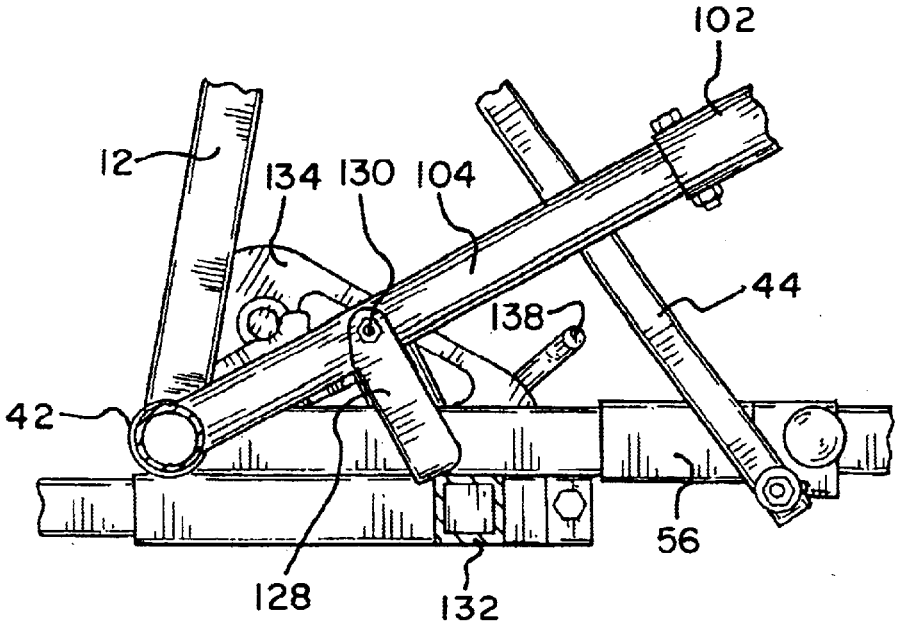
FIG. 7 is a side elevational view similar to FIG. 6 showing the operation of a support means for maintaining the movable arms in an accessible position.

The apparatus shown in solid lines in FIG. 3 illustrates the same in its proper position so that a person can sit on the seat 66 and grasp the handles 114 in order to exercise the upper body. The arm 102 is maintained in this upper operative position through the use of a stop member 128 that is hinged at 130 to the lower part of the base arm member 104 above the pivot point 42. The bottom of the stop member 128 engages a cross bar 132 secured to the frame. As shown in FIG. 6, when the arm 102 is pivoted forwardly, the stop member 128 simply moves with it and remains at an angle of approximately 90° thereto so that when the arm is again moved backwardly, the stop member 128 engages the cross bar 132. However, when it is desired to totally lower the arm 102 for storage or shipping, the stop member can be manually pivoted upwardly so as to be in substantial alignment with the arm 102. The end of the stop member 128 then clears the cross bar 132 as the arm 102 is lowered into its lower most position as shown in FIG. 1.

The exercise apparatus 10 of the invention utilizes a novel force resistor system for adjusting the resistive force needed to move the arms 102 and 102*a* relative to the frame of the apparatus. Two currently preferred novel systems are shown in FIGS. 10–14. These are, of course, by way of example only as other variations may also be possible.

Figure 10:
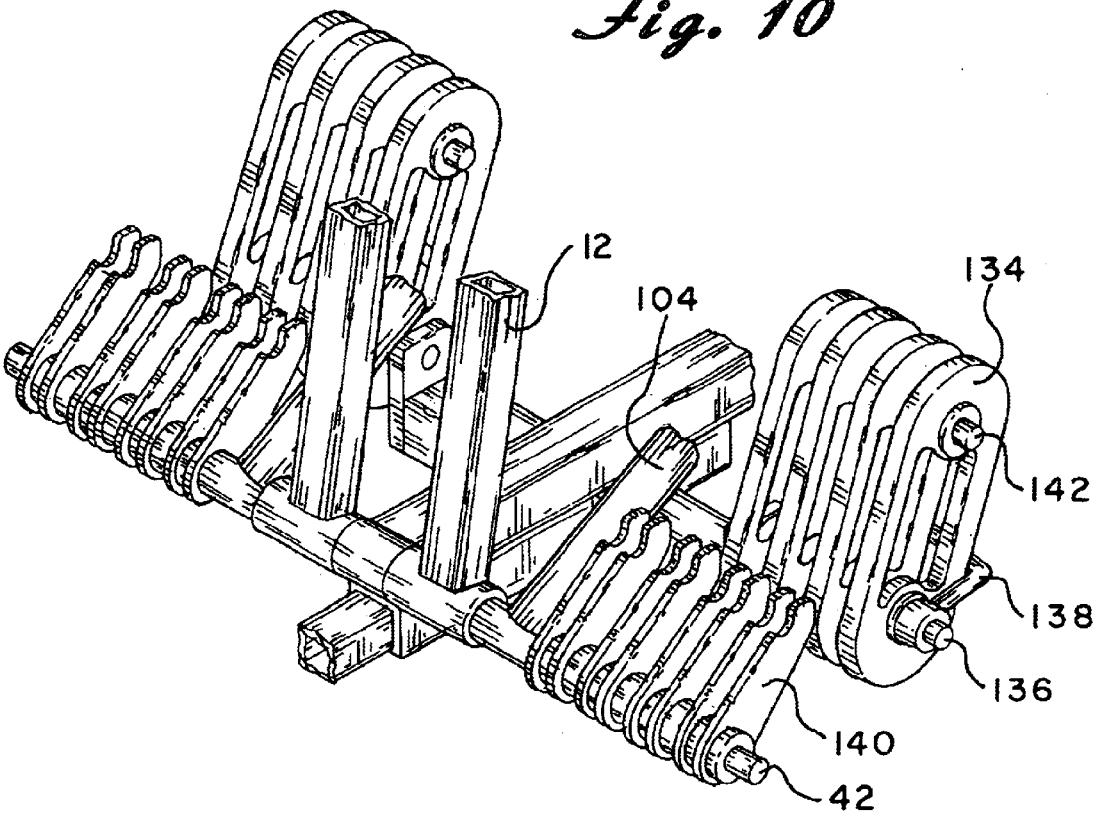
FIG. 10 is a perspective of a first embodiment of a force resistor useful with the exercise apparatus.
Figure 11:
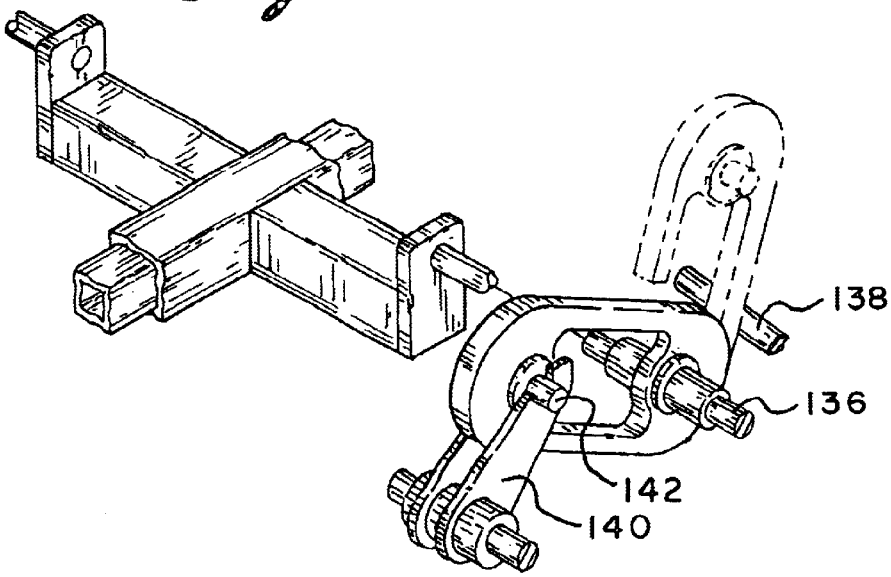
FIG. 11 is an exploded view similar to FIG. 10 with portions broken away illustrating the operation of a part of the force resistor means.

In the embodiment of the invention shown in FIGS. 10 and 11, a plurality of individual rubber bands such as shown at 134 are provided. Preferably, each of the rubber bands 134 requires a different force to extend the same. This can be accomplished by either making the center opening larger or smaller or changing the composition of the material from which the bands are made. All of this is, per se, known in the art. In any case, the lower end of each of the bands 134 is pivoted to a fixed pivot point 136 which, in turn, is rigidly secured to the base frame of the apparatus 10. In their inoperative position, the bands 134 lean slightly rearwardly and rest on a support bar 138. The bands 134 stay on the support bar 138 simply by gravity as they are resting rearwardly beyond the vertical point.

Located forwardly of the elastomeric bands 134, are a plurality of hooks 140. These hooks are mounted so as to be freely rotatable about the axis 42. However, they are rigidly secured to the arm 102 through the lower most part 104 thereof. That is, as the arm 102 is moved so as to rotate about the axis 42, the hooks 140 move therewith. Although not absolutely necessary, it is also preferred to have the arm 102 move independently of the arm 102*a*. Thus, one arm can move while the other can be at rest. As will be apparent, this also allows different forces to be applied to the different arms.

The top free end of each of the bands 134 includes a stud 142 that extends to both sides thereof parallel to the axis 136. When it is desired to employ any one or combination of the bands 134, all that is necessary is for the user to pivot the band forwardly so that the appropriate hook 140 engages the pin 142 as shown in FIG. 11. In this position, as the arm 102 is moved, the hook 140 also moves stretching the band 134 which creates the resistive force. When it is desired to change the resistive force by removing one or more of the bands, all that is necessary is to again rotate the band upwardly and rearwardly into its rest position where it is not engaged by the hook 140. As can best be seen from FIG. 3, this can be easily accomplished while the user is sitting on the seat 66 by simply lowering his or her arm downwardly and behind so as to grasp the appropriate elastomeric band 134 on either side of the apparatus.

Figure 12:
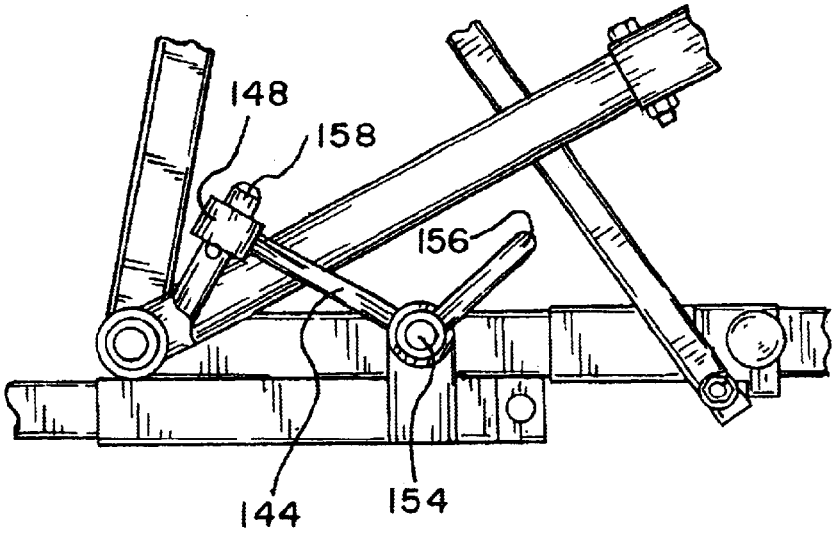
FIGS. 12, 13, and 14 illustrate a second embodiment of a force resistor useful with the exercise apparatus.
Figure 13:
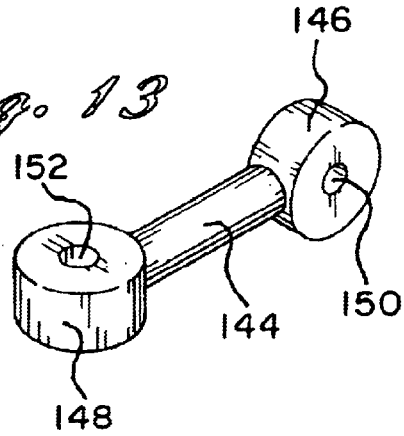
Figure 14:
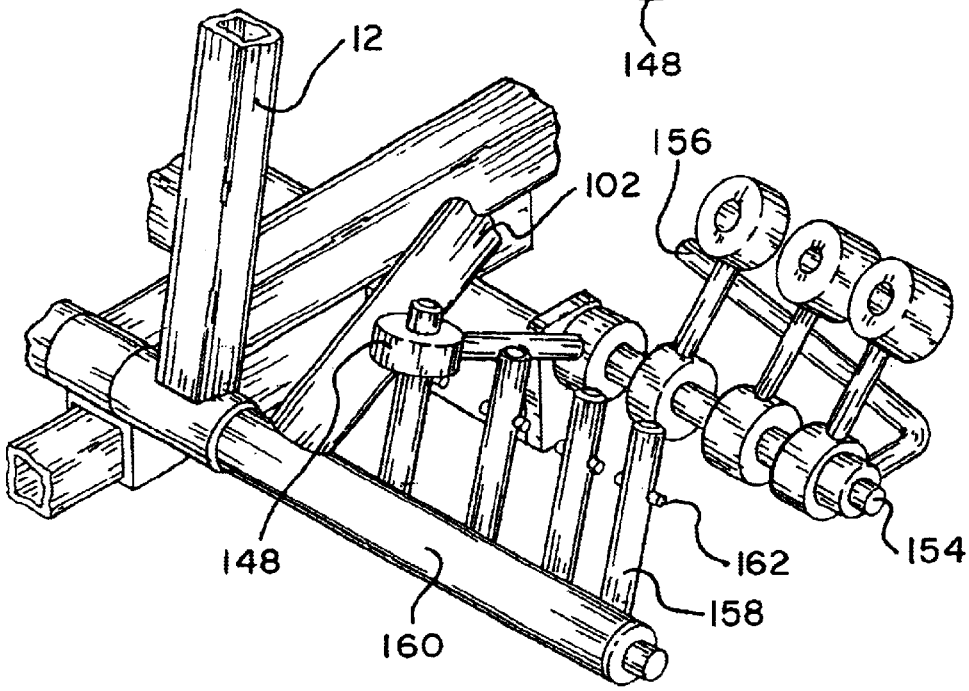

A modified form of the force resister is shown in FIGS. 12–14. In this embodiment, the bands 134 are replaced by elongated elastomeric rods 144 having hubs 146 and 148 at the ends thereof with apertures 150 and 152 passing therethrough at essentially right angles to each other as best shown in FIG. 13. The plurality of elastomeric rods 144 are freely pivotable about the axle 154 between and inoperative position wherein they rest on the support 156 much like the first embodiment and an operative position such as shown at FIG. 12.

In lieu of the hooks 140, this embodiment of the invention includes a plurality of upstanding pins 158 that are rigidly secured to a sleeve 160 that extends about the axle 42 so as to be freely rotatable thereof. As with the first embodiment, the pins 158 are secured through the sleeve 162 to the arm 102 so as to rotate therewith. When it is desired to engage one or move of the elastomeric rods 144 and place the same in its operative position, all that is needed is to reach back and rotate the desired element forwardly until the opening 152 in the hub 148 fits over the top of the rod 158 as shown in FIGS. 12 and 14. Stop members 162 prevent the hubs 148 from moving downwardly to far onto the pins 158. Obviously the amount of force can be changed by combining the various elastomeric rods 144 or by using different rods if they are mode of different elastomeric strengths. Again, this can be done by either modifying the size or shape of the rods or by modifying the materials from which they are made.

As should be readily apparent to those skilled in the art, it is not absolutely necessary to have each of the rods 144 pivotable about the axle 154. Rather, the hubs 146 could be fixed relative thereto and the remainder of the rods be "movable" by merely being flexed or bent between their inoperative and operative positions. In such event, holding means may be provided for maintaining each rod 144 in either its inoperative or operative position.

Because the arm extension 108 can move in substantially any direction with respect to the arm base member 104, various types of upper body exercises can be done with the user sitting on the seat 66 facing forwardly and grasping the handles 114. The user can also turn around facing rearwardly and pull on the handles 114. The amount of force can be adjusted utilizing the adjustable force resistors described above.

Figure 5:
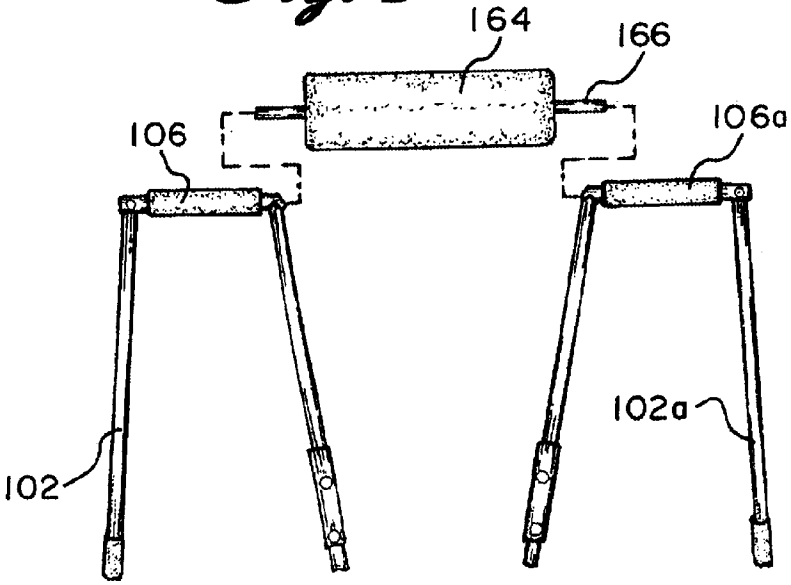
FIG. 5 is an exploded view of a portion of the device showing a center cushion being attached to the movable arms.
Figure 9:
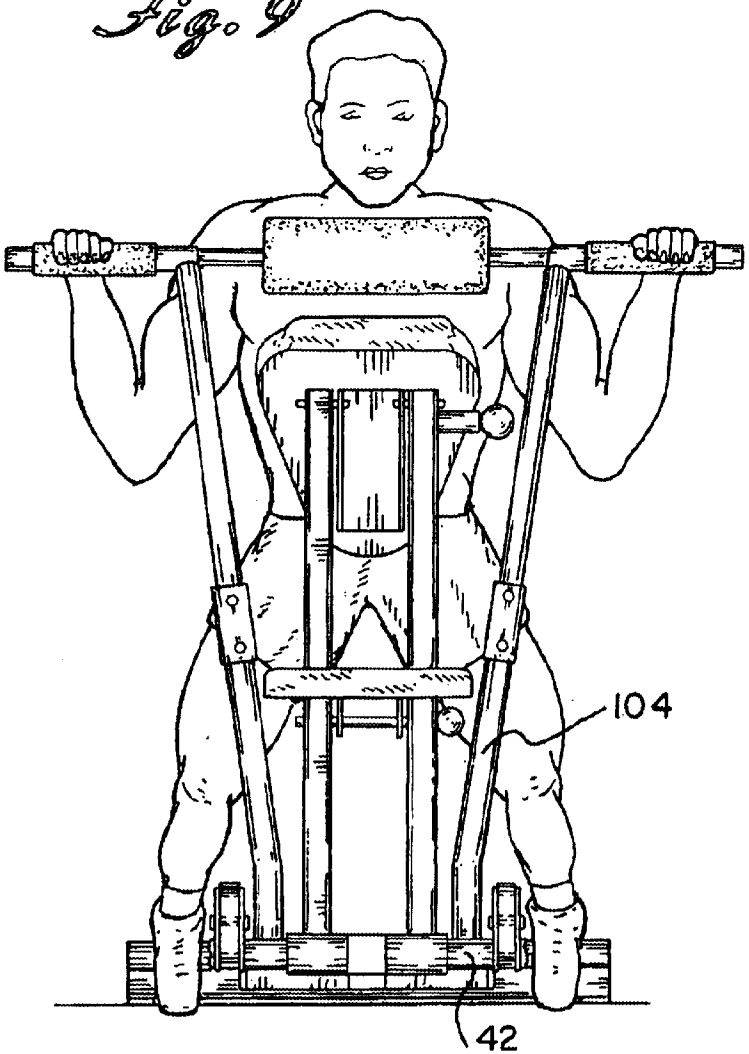
FIG. 9 is a front elevational view illustrating a user of the equipment doing leg squats.

The apparatus 10 of the present invention can also be utilized to perform squats and similar exercises are shown in FIGS. 9, 15 and 16. In order to perform these types of exercises, the seat back 70 is first rotated and locked into the position shown in FIGS. 15 and 16. Whereafter, a cushioned cylindrical pad 164 having coaxial pins 166 extending from each end thereof is placed between the two intermediate arm portions 106 and 106*a* as shown in FIG. 5. This is accomplished by inserting the pins 166 into the hollow center portion of the intermediate sections 106 and 106*a*.

Employing the cylindrical cushion 164 forces the two arms 102 and 102*a* to move in unison with each other. This is preferable for squats and similar exercises. The user then positions himself as shown in solid lines in FIG. 15 with his feet on the foot support 36 while grasping the intermediate arm portions 106 and 106*a* with his hands. He then stands while leaning forward and pushes the moveable arms upwardly against the force of the elastomeric force resistors in order to perform squats and similar exercises.

The present invention may be embodied in other specific forms without departing from the spirit or essential attributes thereof and accordingly, reference should be made to the appended claims rather than to the foregoing specification as indicating the scope of the invention.

I claim:

1. An exercising apparatus which allows a user to perform a variety of exercises and which can be easily collapsed for shipping or storage and easily erected for use including:

a frame, said frame including an upper frame member and a lower base frame member, said lower base frame member extending longitudinally and having a forward end and a rearward end;

means carried by said lower base frame member for supporting the same on the ground;

a seat mounted to said upper frame member, said seat including a seat bottom and a seat back, and including means allowing said seat bottom to be movable between an inoperative position wherein it is substantially parallel to said upper frame member and an operative position wherein it is substantially perpendicular to said upper frame member thereby permitting a user to sit thereon while facing forwardly;

said upper frame member being pivotally attached to said lower base frame member adjacent the forward end thereof and being movable between an inoperative collapsed position wherein it is substantially parallel to said lower base frame member and an erect operative position for use, and means movable with said upper frame member for guiding the same between said inoperative and operative positions and for maintaining the same in said operative position, said guiding and maintaining means including a collar and an elongated rod having a first end pivotally secured to said upper frame member and a second end pivotally connected to said collar, said collar being slidable along a length of said lower base frame member for securing said elongated rod to said lower base frame member in a first position wherein said upper frame member is in its collapsed position and in a second position wherein said upper frame member is in its erect operative position.

2. The exercising apparatus as claimed in claim 1 further including means for preventing movement of said collar relative to said lower base frame member.

3. The exercising apparatus as claimed in claim 2 wherein said movement preventing means includes an aperture in said collar, a plurality of apertures in said lower base frame member and a pin, said pin being insertable through said aperture in said collar and through one of said apertures in said lower base member when said apertures are in alignment with each other.

4. The exercising apparatus as claimed in claim 1 including means for adjusting the position of said seat bottom relative to said upper frame member.

5. The exercising apparatus as claimed in claim 1 including means for adjusting the position of said seat back relative to said upper frame member.

6. The exercising apparatus as claimed in claim 1 including means for adjusting the longitudinal length of said lower base frame member.

7. The exercising apparatus as claimed in claim 6 wherein said length adjusting means includes means telescoping from the forward end of said lower base frame member.

8. In an exercising apparatus having at least one fixed member and at least one movable member and an adjustable force resistance means for adjusting the force needed to move said movable member relative to said fixed member wherein said adjustable force resistance means is of the type which includes a plurality of elastomeric elements and wherein the force is adjusted by selectively connecting one or more of said elements between said fixed member and said movable members, the improvement comprising each of said elastomeric elements being connected to said fixed member so as to be independently movable relative thereto and being movable between a first inoperative position wherein it does not engage said movable member and a second operative position wherein it engages said movable member for movement therewith, said movable member having a plurality of different engaging means equal in number to at least the number of said elastomeric elements and wherein each of said elastomeric members is movable independently of each of the other elastomeric members to engage a different one of said engaging means whereby any one said elastic members and any combination of said elastic members can be moved between inoperative and operative positions without moving or interfering with any other elastic member.

9. The improvement as claimed in claim 8 further including means for maintaining said elastomeric elements in said inoperative position.

10. The improvement as claimed in claim 8 wherein each of said elastomeric elements is connected to said fixed member so as to be independently pivotable relative thereto and being pivotable between said first and second positions, said elastomeric elements engaging said engaging means when pivoted into said second position.

11. The improvement as claimed in claim 8 wherein each of said elastomeric elements is elongated and has a first end connected to said fixed member and a second end adapted to engage a different one of said engaging means on said movable member.

12. The improvement as claimed in claim 11 wherein said fixed member includes an axle and wherein the first end of each of said elastomeric elements is mounted for pivotal movement about said axle.

13. The improvement as claimed in claim 11 wherein the second end of each of said elastomeric elements includes a projection and wherein said engaging means on said movable member includes a plurality of hook means adapted to selectively engage said projections.

14. The improvement as claimed in claim 11 wherein the second end of each of said elastomeric elements includes an aperture and wherein said engaging means on said movable member includes a plurality of projections adapted to selectively engage said apertures.

15. An exercising apparatus which allows a user to perform squat type exercises, said apparatus including:

a frame having a lower base frame member, said lower base frame member extending longitudinally and having a forward end and a rearward end;

means carried by said lower base frame member for supporting the same on the ground;

foot support means carried by said lower base frame member adjacent said rearward end thereof, said foot support means supporting a user's feet so that said user's body extends forwardly at an angle relative to the longitudinal direction of said base member, said foot support means further being fixed to and immovable relative to said base frame member;

a pair of movable arms carried by said frame member and movable relative thereto, said arms including hand grips located forward of said foot support means and adapted to be grasped by the user's hands, and force resistance means for resisting free movement of said arms relative to said frame member.

16. An exercise apparatus as claimed in claim 15 further including an upper frame member and a seat mounted to said upper frame member, said seat including a seat bottom and a seat back, and including means allowing said seat back to be movable into a position wherein it is substantially parallel to the angle of inclination of the user while said user is performing squat exercises.

17. An exercise apparatus as claimed in claim 15 wherein said force resistance means is adjustable so that the amount of force needed to move said arms relative to said frame is adjustable.

18. An exercise apparatus as claimed in claim 17 wherein said adjustable force resistance means is of the type which includes a plurality of elastomeric elements and wherein the force is adjusted by selectively connecting one or more of said elements between said arms and said frame.

19. An exercise apparatus as claimed in claim 18 wherein each of said elastomeric elements being pivotally connected to said frame so as to be independently pivotable relative thereto and being pivotable between a first inoperative position wherein it does not engage said arm and a second operative position wherein it engages said arm for movement therewith.

20. An exercising apparatus which allows a user to perform a variety of exercises and which can be easily collapsed for shipping or storage and easily erected for use including:

a frame, said frame including an upper frame member and a lower base frame member, said lower base frame member extending longitudinally and having a forward end and a rearward end;

means carried by said lower base frame member for supporting the same on the ground;

a seat mounted to said upper frame member, said seat including a seat bottom and a seat back, thereby permitting a user to sit thereon;

said upper frame member being attached to said lower base frame member adjacent the forward end thereof and being movable between an inoperative position and an erect operative position for use;

an arm including a grasping means located on each side of said upper frame member such that a user can grasp the arm with each of his hands while seated on said seat bottom facing rearwardly toward said seat back to perform a variety of exercises, said arm being pivotally attached to said lower base frame adjacent the forward end thereof and being movable to positions rearwardly of said seat back during the performance of said exercises, and force resistance means for resisting free movement of said arm relative to said frame.

21. An exercising apparatus which allows a user to perform a variety of exercises and which can be easily collapsed for shipping or storage and easily erected for use including:

a frame, said frame including an upper frame member and a lower base frame member, said lower base frame member extending longitudinally and having a forward end and a rearward end;

means carried by said lower base frame member for supporting the same on the ground;

a seat mounted to said upper frame member, said seat including a seat bottom and a seat back, and including means allowing said seat bottom to be movable between an inoperative position wherein it is substantially parallel to and in substantially the same plane as said seat back and said upper frame member and an operative position wherein it is substantially perpendicular to said upper frame member thereby permitting a user to sit thereon while facing forwardly;

said upper frame member being removably attached to said lower base frame member adjacent the forward end thereof and being movable between an inoperative collapsed position an erect operative position for use, and means for maintaining said upper frame member on said lower base frame member in said operative position.

* * * * *